US007243713B2

(12) United States Patent
Isaacks et al.

(10) Patent No.: US 7,243,713 B2
(45) Date of Patent: Jul. 17, 2007

(54) SHEAR/SEAL RAM ASSEMBLY FOR A RAM-TYPE BLOWOUT PREVENTION SYSTEM

(75) Inventors: C. Steven Isaacks, Cypress, TX (US); Harry P. Hiebeler, Houston, TX (US); Noe Tony Cordova, Houston, TX (US); Jimmy Livingston, Houston, TX (US); Russell C. Gilleylen, Houston, TX (US)

(73) Assignee: National-Oilwell DHT, L.P., Houston, TX (US)

( * ) Notice: Subject to any disclaimer, the term of this patent is extended or adjusted under 35 U.S.C. 154(b) by 289 days.

(21) Appl. No.: 10/998,378

(22) Filed: Nov. 29, 2004

(65) Prior Publication Data

US 2006/0113501 A1 Jun. 1, 2006

(51) Int. Cl.
*E21B 33/06* (2006.01)
*E21B 29/08* (2006.01)

(52) U.S. Cl. ..... 166/85.4; 166/55; 166/55.1

(58) Field of Classification Search ..... None
See application file for complete search history.

(56) References Cited

U.S. PATENT DOCUMENTS

| | | | | |
|---|---|---|---|---|
| 4,580,626 A | | 4/1986 | Jones | 166/55 |
| 4,646,825 A | | 3/1987 | Van Winkle | 166/55 |
| 4,690,411 A | | 9/1987 | Van Winkle | 277/166 |
| 4,911,410 A | * | 3/1990 | Baker | 251/327 |
| 4,943,031 A | | 7/1990 | Van Winkle | 251/1.3 |
| 4,997,162 A | * | 3/1991 | Baker et al. | 251/327 |
| 5,590,867 A | | 1/1997 | Van Winkle | 251/1.3 |
| 5,863,022 A | | 1/1999 | Van Winkle | 251/1.1 |
| 6,006,647 A | | 12/1999 | Van Winkle | 91/41 |
| 6,244,336 B1 | | 6/2001 | Kachich | 166/55 |
| 6,719,042 B2 | | 4/2004 | Johnson et al. | 166/55 |

OTHER PUBLICATIONS

International Search Report and Written Opinion, Dec. 18, 2006, for foreign counterpart PCT Application PCT/USO5/42796.

* cited by examiner

*Primary Examiner*—Frank Tsay
(74) *Attorney, Agent, or Firm*—Howrey LLP

(57) ABSTRACT

An improved shear/seal ram assembly used in ram-type BOPs is disclosed. The disclosed invention is a unique shear/seal ram assembly in which rail seal actuators attached to or integrally formed in a planar surface of one shear blade mate with and slide within corresponding rail guide grooves formed in a planar surface of a second shear blade. As the shear blades move over each other, the rail seal actuators slide within the rail guide grooves, eventually coming into contact with a seal actuator plate of a unique blade-to-blade seal assembly placed within a shear blade seal groove. Continued movement of the shear blades over each other causes the rail seal actuators to compress, or "energize," the blade-to-blade seal of the blade-to-blade seal assembly, thereby providing a pressure tight seal between the shear blade assemblies.

24 Claims, 4 Drawing Sheets

SHEAR/SEAL RAM ASSEMBLY FOR A RAM-TYPE BLOWOUT PREVENTION SYSTEM

FIELD OF THE INVENTION

The present invention relates to ram-type blowout preventers ("BOPs") used in oil and gas operations for well control including preventing a well blowout. In particular, the present invention relates to the design and use of an improved shear/seal ram assembly used in ram-type BOPs.

BACKGROUND OF THE INVENTION

In the drilling of an oil and/or gas well, a specially formulated fluid known as "drilling mud" is circulated through the wellbore. During rotary drilling operations, the drilling mud serves multiple functions, including protecting against blowouts by holding back subsurface pressures of formation fluids. As long as the bore hole contains a sufficient volume of drilling mud of a sufficient density, the pressure created by the weight of the column of drilling mud is typically sufficient to prevent formation fluids from entering the bore hole. If a formation having higher pressure than expected is encountered during drilling operations, however, the potential for formation fluids, including gas, to enter the borehole and migrate toward the surface is present.

When formation fluids enter the bore hole, a pressure spike, or "kick" as they are commonly referred to in the industry, can occur. Ram-type BOPs are part of a pressure control system used in oil and gas drilling operations to control these unexpected well bore pressure "kicks." The BOPs are designed to close off the well to prevent a blowout by sealing the well against the fluid pressure from below. By sealing the well, the BOP prevents gas (and other well fluids) from migrating past the BOP stack to the drill floor of a rig where numerous potential ignition sources exist that could ignite the gas and thereby cause a blowout. A BOP can also be used to seal off the well around the drill string in normal drilling operations involving positive downhole pressure.

BOPs are typically included in the surface assembly at a wellhead when drilling or completing a well. Typically, multiple BOP rams are assembled in a vertical stack that is positioned over and connected to the wellhead.

The BOP has a central valve body with a vertical bore running through it. Wellbore tubulars, such as the drill string or coiled tubing, extend up through the center, vertical bore of the BOP stack. Similarly, during wireline logging operations, wireline extends up through the center, vertical bore of the BOP stack. Depending on the operations being conducted on the well, other wellbore equipment may be within the vertical bore of the BOP stack at a particular time.

A typical BOP has a plurality of laterally disposed, opposing actuator assemblies fastened to the valve body. Each actuator assembly includes a piston that is laterally moveable within an actuator body by pressurized hydraulic fluid (during normal operation) or by manual force (in the event of a failure of the hydraulic control system). Each piston has a stem threadably engaged or otherwise connected to it. The stem extends laterally toward the bore of the valve body and has a ram body attached to the end of the stem nearest the bore of the valve body.

Replaceable sealing elements are mounted within or on the ram bodies that extend into the vertical bore of the valve body of the BOP. When the pistons of the BOPs are moved to a closed position, commonly referred to as "closing the rams," the vertical bore of the BOP is sealed and the well bore pressure is contained. The sealing elements mounted within or on the ram bodies are available in a variety of configurations designed to seal the vertical bore of the BOP valve body when the opposing rams and pistons are moved to their closed position.

Several types of ram and seal assemblies are used in the actuator assemblies of a BOP stack. One type of ram and seal assembly known as a "pipe ram" utilizes seals designed to seal around the wellbore tubulars within the BOP's vertical bore when the BOP is closed. Each seal of a pipe ram typically has a semicircular opening in its front face to form a seal around half of the outer periphery of the tubular. When the pipe rams are closed, the opposing pipe rams engage each other and seal the entire periphery of the tubular, thereby closing off the annulus between the tubular and the well bore surface.

Another type of ram and seal assembly, known as a "blind ram," seals across the entire wellbore when no tubular is located in the vertical bore at the location of the blind rams. Like pipe rams, the blind rams are designed to engage each other when the BOP is closed. Blind rams, however, typically utilize seals with no opening in the face of the seals such that the blind rams form a complete seal through the vertical bore of the BOP.

BOP stacks typically also include shear, or cutting, rams that shear the tubular (or wireline) when the rams are driven toward each other as the BOP is closed. In operation, the shear rams are typically used as a last resort measure to contain wellbore pressure from causing a blowout. A BOP with shear rams is typically the top section of a ram-type BOP stack, while various pipe rams and blind rams are typically located below the shear rams. In operation, the pipe rams will be closed first to try to contain the wellbore pressure and prevent a potential blowout. In the event the pipe rams (and/or the blind rams) do not contain the "kick," the shear rams are actuated to try and contain the "kick" and prevent a potential blowout.

The shear ram assemblies must be sealed to prevent wellbore fluids from migrating through or around the shear blades after the tubular or other item within the valve body of the BOP is sheared. Various prior art patents disclose shear rams with integral sealing means disposed on or within the shear blades and/or within the shear ram bodies. Such prior art patents include U.S. Pat. Nos. 4,580,626; 4,646,825; 6,244,336; and 6,719,042. Each of these patents energize the seal between the shear blades in different ways. However, the designs of the sealing mechanisms of each of these prior art patents have certain drawbacks that limit the amount of squeeze that may be placed on the seals and/or that make replacement of the sealing components difficult.

The present invention offers an improved sealing mechanism that "energizes" the sealing element between the shear blades in a unique way and that offers a design that allows for easy replacement of the seal assembly. Thus, the sealing mechanism of the present invention overcomes many of the drawbacks of the prior art.

SUMMARY OF THE INVENTION

An improved shear/seal ram assembly used in ram-type BOPs is disclosed. The disclosed invention is a unique shear/seal ram assembly in which rail seal actuators attached to or integrally formed in a planar surface of one shear blade mate with and slide within corresponding rail guide grooves formed in a planar surface of a second shear blade. As the shear blades move over each other, the rail seal actuators slide within the rail guide grooves, eventually coming into contact with a seal actuator plate of a unique blade-to-blade seal assembly placed within a shear blade seal groove. Continued movement of the shear blades over each other causes the rail seal actuators to compress, or "energize," the blade-to-blade seal, thereby providing a pressure tight seal between the shear blade assemblies.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

FIG. 3A further shows the pivoting seal protector used to lift the sheared tubular such that the bottom of the upper portion of the sheared tubular is prevented from sliding across and damaging the sealing mechanism of the shear/seal ram assembly of the present invention.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Figure 1:
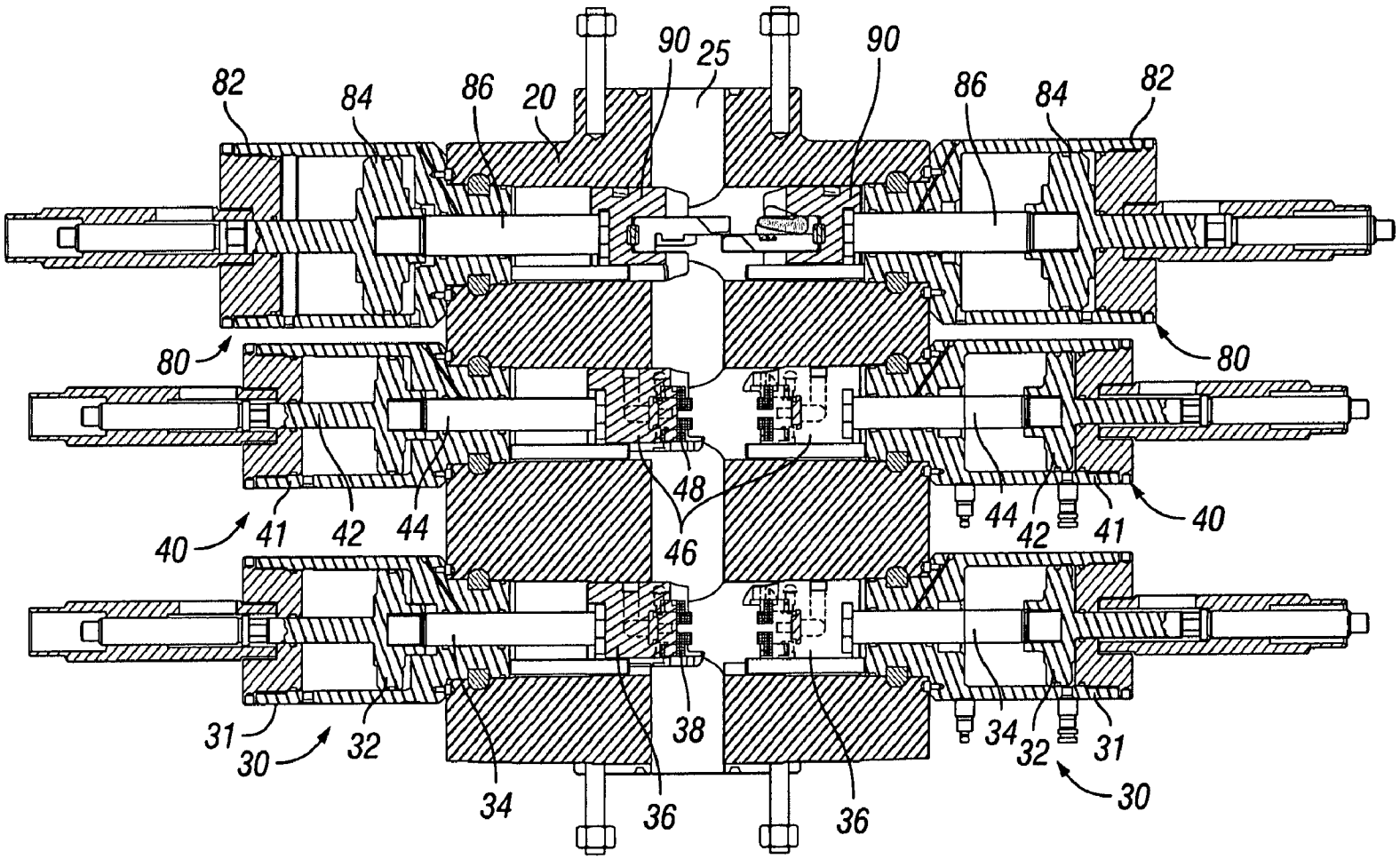
FIG. 1 is a vertical cross-sectional view of a typical BOP stack comprising multiple ram assemblies.

Referring to FIG. 1, a BOP stack 10 is shown in cross-section. As can be seen in FIG. 1, BOP stack 10 is comprised of valve body 20 (having central bore 25 running therethrough) with pipe ram actuator assemblies 30 and 40 and shear/seal ram actuator assembly 80 connected thereto.

Pipe ram actuator assemblies 30 are the lowermost actuator assemblies connected to valve body 20. Each pipe ram actuator assembly 30 comprises actuator body 31, piston 32, stem 34, ram body 36, and ram packer 38. Stem 34 operatively connects piston 32 with ram body 36.

Proceeding upwardly along BOP stack 10, pipe ram actuator assemblies 40 are the next level of rams connected to valve body 20. Each pipe ram actuator assembly 40 comprises actuator body 41, piston 42, stem 44, ram body 46, and ram packer 48. Stem 44 operatively connects piston 42 with ram body 46. Pipe ram actuator assemblies 40 are substantially identical to pipe ram actuator assemblies 30.

Shear seal ram actuator assemblies 80 are connected to valve body 20 above pipe ram actuator assemblies 40. Each shear/seal ram actuator assembly 80 comprises actuator body 82, piston 84, stem 86, and ram body 90. Stem 86 operatively connects piston 84 with ram body 90. As will be discussed in more detail below with reference to FIGS. 2 through 5, ram body 90 comprises a unique sealing mechanism for sealing between the upper and lower blades, or shears, connected to ram body 90.

In operation, when a well experiences a "kick," the pistons 32 within the lowermost pipe ram actuator bodies 31 will be activated via hydraulic pressure (in normal operation) or manually (in the event of a failure of the hydraulic control system) such that the ram packers 38 will be driven laterally inwardly toward the vertical bore 25 running through valve body 20. Eventually, the ram packers 38 of ram bodies 36 will be forced together such that the ram packers 38 will form a seal around the entire circumference of a wellbore tubular passing through vertical bore 25. In this way, ram packers 38 are designed to prevent wellbore fluids from migrating upwardly through vertical bore 25. Similarly, the pistons 42 within ram actuator bodies 41 may be activated as a redundant sealing mechanism or may be necessary in the event of a failure of the lowermost pipe rams to contain the kick.

In the event the pipe rams of BOP stack 10 fail to adequately contain the wellbore pressure, the shear/seal rams of shear/seal actuator assemblies 80 will be activated. As with the pipe rams, the pistons 84 within the actuator bodies 82 will be activated via hydraulic pressure such that the ram bodies 90 will be driven laterally inwardly toward the vertical bore 25 running through valve body 20. Eventually, the shear blades (numbers 100 and 150 in FIGS. 2 through 5) connected to ram bodies 90 will be forced together such that the blades will shear the wellbore tubular (or wireline) passing through vertical bore 25. At the same time, the sealing mechanism of the present invention is activated to form a seal between the shear blades, thereby preventing the flow of wellbore fluids beyond the shear blades. Drilling mud can then be pumped downwardly through the BOP stack 10 to contain the kick.

Figure 2:
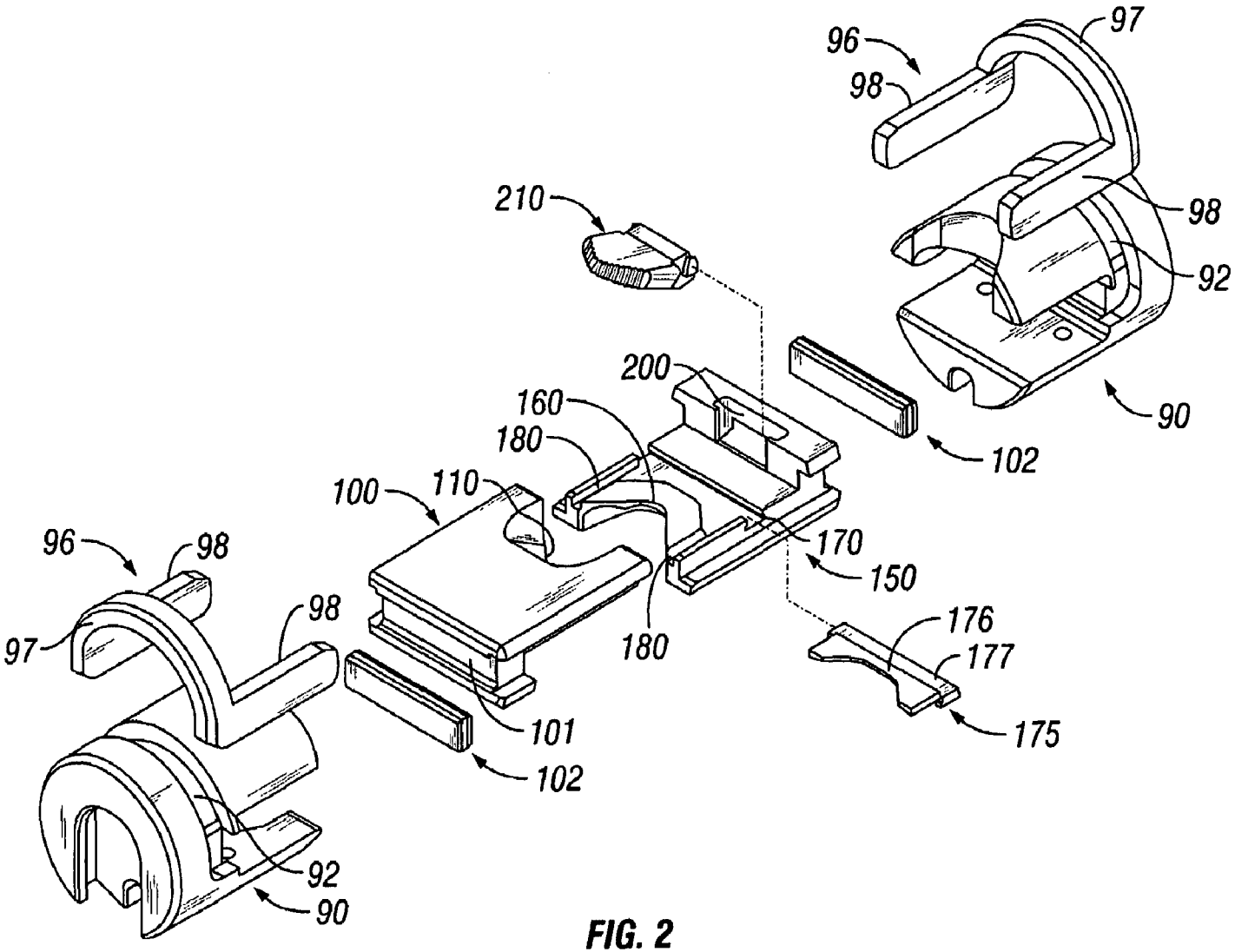
FIG. 2 is an exploded view of mating shear/seal ram assemblies showing the shearing and sealing components of the assemblies in accordance with the preferred embodiment of the present invention.

FIG. 2 is an exploded view of the shear/seal ram assemblies of the prevent invention. As can be seen in FIG. 2, ram bodies 90 each contain multiple seal grooves for housing seals that prevent wellbore fluids from flowing around the ram bodies when activated. Specifically, ram bodies 90 each contain an outer seal groove 92 that is shaped to receive a specially shaped outer seal 96. Outer seal 96 comprises a curved top seal 97 that is designed to provide a seal along the top surface of ram body 90, and horizontal side seals 98 that are designed to provide a seal along opposite sides of ram body 90.

Figure 5:
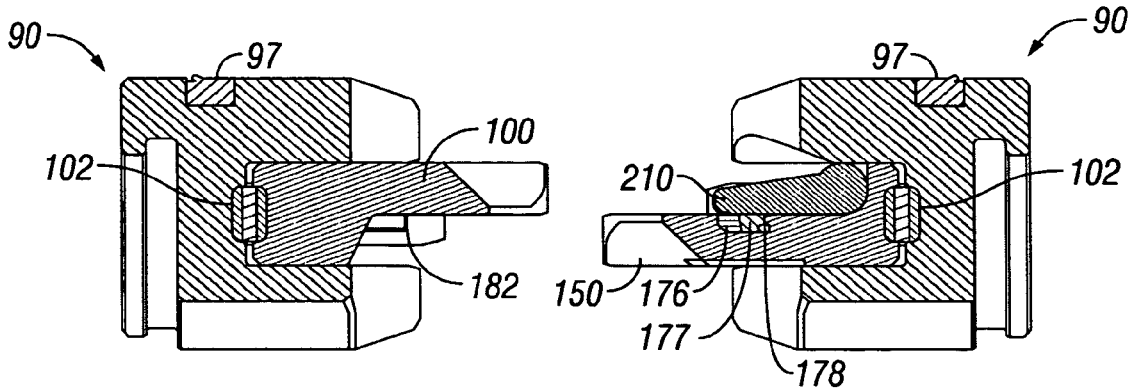
FIG. 5 is a cross-sectional view of the shear blades and ram bodies of FIG. 4 viewed along the line 5—5 shown in FIG. 4.

To seal the area between the upper and lower shear blades 100 and 150 and the ram bodies 90, each shear blade 100 and 150 has a rear seal groove 101 formed in the back portion of the shear blade. Rear seal grooves 101 are shaped to receive a blade-to-ram seal 102. When the shear/seal ram assemblies of the present invention are assembled, the blade-to-ram seal 102 is compressed between the ram body 90 and the shear blade 100 or 150 to form a seal (as shown in FIG. 5).

FIG. 2 also shows certain components of the unique sealing mechanism of the present invention used to seal the area between the upper shear blade 100 and the lower shear blade 150 after they have been actuated and have sheared the wellbore tubular (or other member) within vertical bore 25. As will be discussed in more detail below with reference to FIGS. 3 through 5, the lower shear blade 150 contains a shear blade seal groove 170 that is specially shaped to receive a blade-to-blade seal assembly 175. The blade-to-blade seal assembly 175 comprises a blade-to-blade seal 177 molded to or otherwise connected to a seal actuator plate 176, the blade-to-blade seal 177 having an integral solid retainer 178 (shown in FIG. 5) connected thereto. Additionally, FIG. 2 shows the rail guide grooves 180 formed in lower shear blade 150 that are designed to receive and guide the rail seal actuators (shown as number 182 in FIGS. 3B and 5).

One of skill in the art will appreciate that the seals 96 and 102 and the blade-to-blade seal assemblies 175 of the present invention are designed such that they are easy to assemble onto and within the shear/seal ram assemblies. Unlike some prior art shear/seal assemblies, the seals 96 and 102 and the blade-to-blade seal assemblies 175 of the present invention provide for easy removal and replacement when the seals become worn.

FIG. 2 further shows groove 200 formed in lower shear blade 150. Groove 200 is shaped to receive seal protector 210. Seal protector 210 is specially shaped to pivot upwardly about its points of contact within groove 200 when the nose of seal protector 210 contacts a wellbore tubular (or wireline) when the ram bodies 90 are driven towards each other during operation (discussed in more detail with reference to FIGS. 3A through 5 below).

The unique sealing mechanism of the present invention will now be discussed with reference to FIGS. 3A through 5. As can be seen in these figures, blade-to-blade seal assembly 175 rests within shear blade seal groove 170 formed in lower shear blade 150. Seal actuator plate 176 of the blade-to-blade seal assembly 175 is specially shaped such that its middle section is recessed relative to its outer ends. The outer ends of the blade-to-blade seal assembly 175 are sized to extend toward rail guide grooves 180.

Figure 3A:
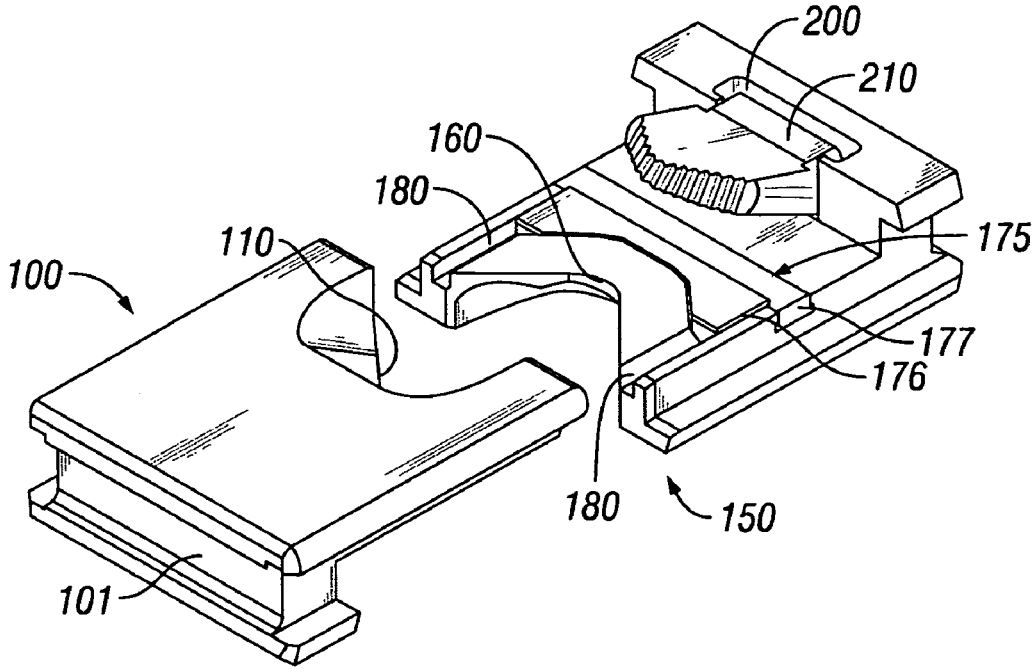
FIG. 3A is a view of the upper and lower shear blades from above the blades showing the shearing and sealing components of the assembly in accordance with the preferred embodiment of the present invention.
Figure 3B:
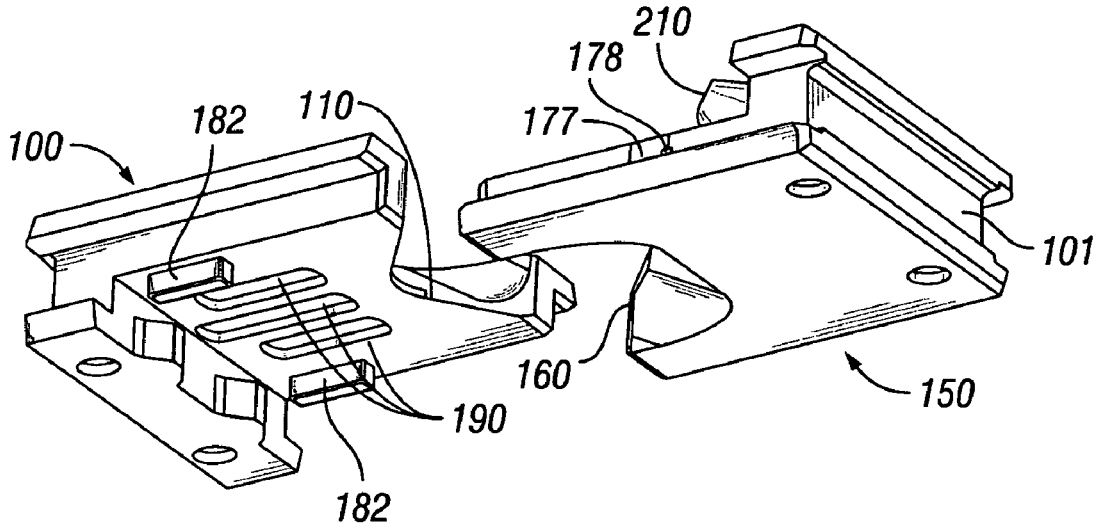
FIG. 3B is a view of the upper and lower shear blades from below the blades showing the shearing and sealing components of the assembly in accordance with the preferred embodiment of the present invention.

As shown in FIGS. 3B and 5, rail seal actuators 182 are integrally formed as part of the underside of upper shear blade 100. Alternatively, rail seal actuators 182 can be attached to the underside of upper shear blade 100 by any suitable attachment means, including, but not limited to, welding. Rail seal actuators 182 are shaped and sized such that when ram bodies 90 are driven laterally toward and into contact with each other, rail seal actuators 182 will slide within rail guide grooves 180 formed in the lower shear blade 150. As the surface of the underside of the upper shear blade 100 passes over the surface of the top side of the lower shear blade 150, the rail seal actuators 182 "slide" within rail guide grooves 180 until they contact the outer ends of the seal actuator plate 176. Although the preferred embodiment of the present invention utilizes two rail seal actuators 182, one of skill in the art will appreciate that more than two rail seal actuators 182 (and thus more than two rail guide grooves 180) or only one rail seal actuator 182 (and thus one rail guide groove 180) may be utilized depending on several factors, including, but not limited to, the size of the shear blades 100 and 150 and the size of blade-to-blade seal 177.

As the seal actuator plate 176 is driven axially backward in shear blade seal groove 170 by the continued movement of rail seal actuators 182, blade-to-blade seal 177 is "squeezed" such that a seal between the upper and lower shear blades 100 and 150 is created. The rail seal actuators 182 are sized so that the optimal "squeeze" on blade-to-blade seal 177 is reached after the wellbore tubular (or other member) is sheared and the upper cutting edges 110 and 160 of upper and lower shear blades 100 and 150 have traveled past the blade-to-blade seal 177.

Blade-to-blade seal 177 is formed with or has connected to it an integral solid retainer 178 (shown in FIG. 5) that maintains the blade-to-blade seal 177 in shear blade seal groove 170 as the seal is compressed. Specifically, shear blade seal groove 170 is shaped to include a "notch" that extends from the lower rear portion of the groove into the lower shear blade 150, the notch being sized to receive the integral solid retainer 178 when the blade-to-blade seal assembly 175 is placed within blade seal groove 170. The integral solid retainer 178 is made of a sufficiently rigid material such that it holds the blade-to-blade seal 177 in place and keeps the blade-to-blade seal 177 from "popping" out of the blade seal groove 170.

FIGS. 3A through 5 also show seal protector 210 operatively placed within groove 200 formed in the lower shear blade 150. As noted, seal protector 210 is designed to pivot about its points of contact with groove 200 when the nose of seal protector 210 contacts a wellbore tubular (or other member). Specifically, in operation, as upper and lower shear blades 100 and 150 move toward and pass over each other to shear a wellbore tubular (or other member), the upper portion of the sheared tubular will be driven toward the blade-to-blade seal assembly 175 as the upper and lower shear blades 100 and 150 continue to pass over each other. To prevent the jagged edge of the sheared tubular (or other member) from cutting or tearing the blade-to-blade seal 177, the nose of the seal protector 210 is designed to "grip" the upper portion of the sheared tubular (or other member). The seal protector 210 is designed to pivot in the upward direction to lift the sheared tubular (or other member) during the shearing process. The nose of the seal protector 210 has a grooved geometry or is serrated such that it frictionally engages the sheared tubular (or other member) to aid in lifting the sheared tubular (or other member).

FIG. 3B also shows channels 190 formed in the bottom planar surface of upper shear blade 100. Channels 190 help facilitate the pumping of drilling mud into the wellbore to contain the wellbore pressure after the tubular (or other member) has been sheared and the seal between the shear blades 100 and 150 has been "energized." Specifically, after an upper shear/seal ram assembly and a lower pipe ram assembly have been "closed," drilling mud can be pumped from an external system into the valve body through a "pump-in port" on the side of the valve body between the shear/seal ram assembly and the pipe ram assembly. The drilling mud fills the cavity formed between the closed shear/seal ram assembly and pipe ram assembly. Once this cavity is filled with drilling mud, the mud can then flow through the channels 190, into the inner diameter of the sheared tubular, and down into the wellbore.

Figure 4:
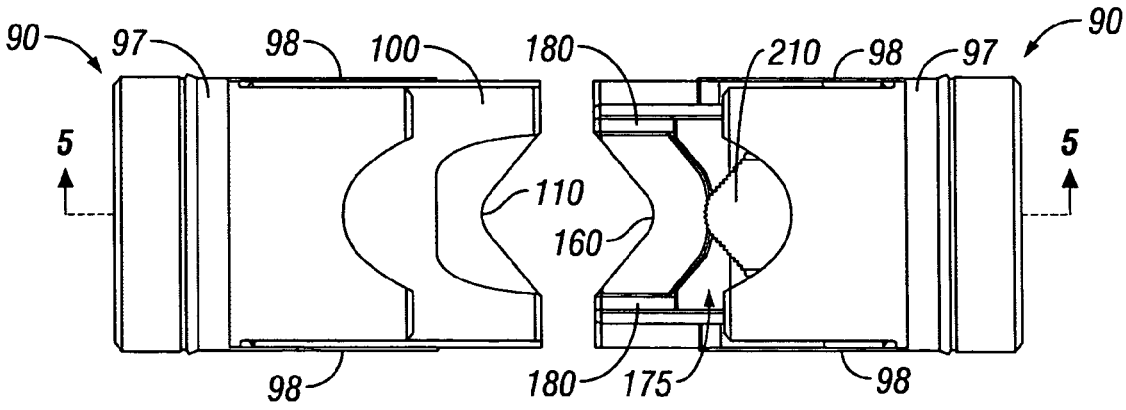
FIG. 4 is a top view of the shear blades and ram bodies of the shear/seal ram assemblies showing the unique sealing mechanism in accordance with the preferred embodiment of the present invention.

FIGS. 4 and 5 show the various seal elements of the ram bodies 90 placed within their respective seal grooves. Specifically, FIG. 4 shows outer seal 96 (comprised of curved top seal 97 and horizontal side seals 98) in place within outer seal groove 92. FIG. 5 shows a cross-section of blade-to-ram seals 102 in place within rear seal grooves 101. FIG. 5 also shows blade-to-blade seal assembly 175 (comprising seal actuator plate 176, blade-to-blade seal 177, and integral solid retainer 178) within shear blade seal groove 170 formed in lower shear blade 150. The combination of outer seals 96, blade-to-ram seals 102, and blade-to-blade seal 177 form a pressure tight sealing system that prevents wellbore fluids from migrating around or through ram bodies 90.

While the apparatus, compositions and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

The invention claimed is:

1. A ram-type blowout preventer for use in oil and gas drilling and workover operations, the blowout preventer comprising:

a valve body having a vertical bore running therethrough;

a pair of opposing actuator assemblies connected to the valve body, each actuator assembly comprising an actuator body, a piston, and a ram body, wherein the ram bodies of the pair of actuator assemblies are laterally movable within the actuator bodies, the ram bodies each having a shear blade connected thereto;

a seal groove formed in one of the shear blades; and a sealing system for sealing between the shear blades, the sealing system comprising a seal assembly positioned substantially within the seal groove, one or more rail seal actuators, and one or more rail guide grooves, wherein the seal assembly comprises an actuator plate, a seal member, and an integral solid retainer for retaining the seal member in the seal groove when the seal member is compressed.

2. The blowout preventer of claim 1 wherein the shear blades comprise an upper shear blade and a lower shear blade.

3. The blowout preventer of claim 2 wherein the one or more rail seal actuators are integrally formed in the bottom planar surface of the upper shear blade.

4. The blowout preventer of claim 2 wherein the one or more rail seal actuators are welded to the bottom planar surface of the upper shear blade.

5. The blowout preventer of claim 1 wherein the one or more rail guide grooves are formed in the top planar surface of the lower shear blade.

6. The blowout preventer of claim 1 further comprising a seal protector for deflecting a portion of a sheared member within the vertical bore of the valve body to avoid contact between the sheared member and the seal member of the seal assembly.

7. The blowout preventer of claim 6 wherein a nose end of the seal protector is serrated to frictionally engage a member within the vertical bore of the valve body.

8. The blowout preventer of claim 1 further comprising one or more channels formed in the bottom planar surface of the upper shear blade.

9. The blowout preventer of claim 8 wherein the one or more channels facilitate fluid flow into a wellbore.

10. The blowout preventer of claim 1 further comprising a sealing means for sealing the area between the end of the shear blades opposite a cutting edge of the shear blades and the ram bodies.

11. The blowout preventer of claim 1 further comprising an outer sealing means for sealing at least a portion of the area between the outer surface of the ram bodies and the inner walls of the valve body.

12. A sealing system for sealing between an upper shear blade and a lower shear blade of a shear ram assembly of a ram-type blowout preventer, the sealing system comprising:

a seal groove formed in the top planar surface of the lower shear blade;

a seal assembly positioned substantially within the seal groove, the seal assembly comprising an actuator plate, a seal member, and an integral solid retainer for retaining the seal member in the seal groove when the seal member is compressed;

one or more rail seal actuators, the one or more rail seal actuators extending downwardly from the bottom planar surface of the upper shear blade; and one or more rail guide grooves formed in the top planar surface of the lower shear blade.

13. The sealing system of claim 12 wherein the one or more rail seal actuators are shaped and sized to slide within the one or more rail guide grooves as the upper shear blade passes over the lower shear blade.

14. The sealing system of claim 12 further comprising a seal protector attached to one of the shear blades for deflecting a portion of a sheared member within a vertical bore of a valve body of the ram-type blowout preventer to avoid contact between the sheared member and the seal member of the seal assembly.

15. The sealing system of claim 14 wherein a nose end of the seal protector is serrated to frictionally engage a member within the vertical bore of the valve body.

16. The sealing system of claim 12 further comprising one or more channels formed in the bottom planar surface of the upper shear blade.

17. The sealing system of claim 16 wherein the one or more channels facilitate fluid flow into a wellbore.

18. The sealing system of claim 12 further comprising a sealing means for sealing the area between the end of one of the shear blades opposite a cutting edge of the shear blade and a ram body of the shear ram assembly.

19. The sealing system of claim 18 further comprising an outer sealing means for sealing at least a portion of the area between the outer surface of the ram body and an inner wall of a valve body of the ram-type blowout preventer.

20. A method of sealing between an upper shear blade and a lower shear blade of a shear ram assembly of a ram-type blowout preventer, the method comprising:

providing a seal groove in the top planar surface of the lower shear blade;

positioning a seal assembly substantially within the seal groove, the seal assembly comprising an actuator plate, a seal member, and an integral solid retainer;

providing the upper shear blade with one or more rail seal actuators that extend downwardly from the bottom planar surface of the upper shear blade;

providing one or more rail guide grooves in the top planar surface of the lower shear blade;

actuating the shear ram assembly such that the upper shear blade passes over the lower shear blade;

causing the one or more rail seal actuators to contact the actuator plate of the seal assembly as the upper shear blade passes over the lower shear blade;

compressing the seal member of the seal assembly as the one or more rail seal actuators contact the actuator plate and move it within the seal groove as the upper shear blade passes over the lower shear blade.

21. The method of claim 20 wherein the one or more rail seal actuators slide within the one or more rail guide grooves as the upper shear blade passes over the lower shear blade.

22. The method of claim 20 further comprising providing a notch in the seal groove for receiving at least a portion of the integral solid retainer of the seal assembly such that the integral solid retainer retains the seal member in the seal groove as it is compressed.

23. The method of claim 20 further comprising providing a seal protector attached to one of the shear blades for deflecting a portion of a sheared member within a vertical bore of a valve body of the ram-type blowout preventer to avoid contact between the sheared member and the seal member of the seal assembly.

24. The method of claim 20 wherein the one or more rail seal actuators push the actuator plate axially backward within the seal groove to compress the seal member of the seal assembly as the upper shear blade passes over the lower shear blade.

* * * * *